US006823903B2

(12) United States Patent
Davis

(10) Patent No.: US 6,823,903 B2
(45) Date of Patent: Nov. 30, 2004

(54) STATIC DISSIPATIVE FUEL DISPENSING NOZZLE

(75) Inventor: E. Linwood Davis, Georgetown, TX (US)

(73) Assignee: Dresser, Inc., Addison, TX (US)

( * ) Notice: Subject to any disclaimer, the term of this patent is extended or adjusted under 35 U.S.C. 154(b) by 0 days.

(21) Appl. No.: 10/417,679

(22) Filed: Apr. 17, 2003

(65) Prior Publication Data

US 2004/0206418 A1 Oct. 21, 2004

(51) Int. Cl.[7] ..... B65B 1/04
(52) U.S. Cl. ..... 141/1; 141/97
(58) Field of Search ..... 141/1, 9, 59, 97, 141/85, 89, 206; 222/14–16; 137/234.6

(56) References Cited

U.S. PATENT DOCUMENTS

| | | | | |
|---|---|---|---|---|
| 3,383,560 A | | 5/1968 | Ginsburgh | 317/2 |
| 3,629,656 A | | 12/1971 | Willig | 317/2 F |
| 4,215,384 A | | 7/1980 | Elson | 361/215 |
| 5,255,723 A | * | 10/1993 | Carmack et al. | 141/206 |
| 5,267,670 A | | 12/1993 | Foster | 222/1 |
| 5,327,943 A | * | 7/1994 | Strock et al. | 141/59 |
| 5,482,094 A | | 1/1996 | Mitchell | 141/209 |
| 5,522,440 A | | 6/1996 | Mitchell | 141/392 |
| 5,549,132 A | | 8/1996 | Butterfield et al. | 137/270 |
| 5,603,364 A | | 2/1997 | Kerssies | 141/392 |
| 5,664,809 A | | 9/1997 | Bates | 285/48 |
| 5,667,113 A | * | 9/1997 | Clarke et al. | 222/608 |
| 5,713,401 A | | 2/1998 | Weeks | 141/59 |
| 5,754,388 A | | 5/1998 | Schmidt | 361/215 |
| 5,755,256 A | | 5/1998 | Elsdon et al. | 137/390 |
| 5,813,432 A | | 9/1998 | Elsdon et al. | 137/413 |
| 5,898,560 A | | 4/1999 | Flaynik, Jr. et al. | 361/215 |
| 5,967,385 A | | 10/1999 | Coates, III | 222/566 |
| 6,024,140 A | * | 2/2000 | Garrison et al. | 141/59 |
| 6,099,726 A | | 8/2000 | Gembolis et al. | 210/243 |
| 6,311,742 B1 | | 11/2001 | Nusen et al. | 141/206 |
| 2001/0046111 A1 | | 11/2001 | Koike et al. | 361/215 |

OTHER PUBLICATIONS

US 2001/0006263 A1 (Hayward), Graphite Foam Material and Method of Making Same, Jul. 5, 2001, see page 1, paragraph 9.*

"LNP Engineering Plastics Fuel Delivery," *www.LNP.com.*

"Stat–Kon—A Guide to LNP's Line of Thermoplastic Composites for Electrostatic Dissipation," *www.LNP.com.*

* cited by examiner

*Primary Examiner*—Timothy L. Maust
(74) *Attorney, Agent, or Firm*—Fish & Richardson P.C.

(57) ABSTRACT

A fuel dispensing nozzle includes a body, a handle connected to the body, a handle guard connected to the body and generally surrounding the handle, and a spout extending from the body. Parts of the nozzle are made of, or covered in, static dissipative materials. Additionally, a method for reducing static discharge in existing nozzle installations include the application of static dissipative material to existing nozzles to address certain static discharge risks.

33 Claims, 4 Drawing Sheets

STATIC DISSIPATIVE FUEL DISPENSING NOZZLE

BACKGROUND OF THE INVENTION

1. Technical Field of the Invention

The invention relates generally to safety devices in a fuel dispensing environment and more particularly to static discharge reduction at the fuel nozzle.

2. Description of Related Art

Fuel dispensing nozzles are well-known in the art for dispensing fuel from a fuel supply into a container. A typical example would be the fuel dispensing nozzle at a retail gasoline station wherein the dispensing nozzle is at the end of a hose connected to a dispenser which is connected to an underground storage tank. The nozzle will typically contain a valve that is actuated by the customer to dispense fuel from the underground storage tank through the dispenser, through the hose, through the nozzle and into the customer's vehicle or gasoline can.

It is understood in the industry that dispensing volatile fuel may present a fire hazard if an ignition source is present near the dispensing nozzle. The danger is created by the fuel vapor emanating from the nozzle container interface. Therefore, it is common for fuel stations to have signs which require users to turn off their vehicles and not light cigarettes in the area of fuel dispensing to prevent such fires. Unfortunately, customers are injured from fires started by static discharge in the area immediately surrounding the nozzle.

While each case is different, two patterns have developed where static discharge is a factor. One pattern involves fuel dispensed into a gasoline can and not the fuel tank of a vehicle. In this scenario, the can is placed on a surface that is electrically insulative, as opposed to conductive, and as the fuel is discharged from the nozzle into the can, static electricity builds up in the can. Then, as the nozzle is withdrawn from the can, the metallic highly electrically conductive nozzle spout may contact the lip of the can causing a static discharge between the can and the spout, which under the right conditions, can ignite the vapor in the immediate area causing a fire which can damage property and cause personal injury.

A second scenario which has proven to cause fires in the gasoline dispensing station involves a customer locking the nozzle open while fuel is being dispensed into the vehicle fuel tank and either returning to their seat in the vehicle or going into the convenience store. The act of sliding in and out of a vehicle, or walking across a carpeted floor, can cause static electricity to build up in the customer's body. Upon returning to the fuel nozzle, in order to retract the nozzle from the vehicle and drive away, the customer reaches down to grasp the nozzle and a static discharge can occur between the customer and the nozzle body or handle or even handle guard. In this situation, the vapor may have built up in the area such that a fire may be ignited causing damage to property and personal injury.

Attempts to prevent sparks in this environment, include the addition of grounding straps to fuel tank filler pipes and other surfaces to prevent the build up of static electricity while filling the vehicle. Unfortunately, these grounding straps do not address the build-up of static electricity in the customer's body as they are moving across the seat of their vehicle or walking on the carpet in the convenience store, nor do they address the build-up of static discharge in a gasoline can that is placed on an insulative surface, such as a bed liner of a pickup truck. In order to address these risks, it has been known to instruct users to place gasoline cans on the ground and have users touch conductive surfaces distant from the nozzle prior to touching the nozzle end to discharge any static electricity in the customer's body.

To the extent users do not follow the directions clearly labeled on the dispenser, the above methods do not effectively reduce the static discharge occurrence in and around the nozzle area. A system is required that would effectively eliminate static discharge in and around the nozzle area without requiring specific actions by the customer.

SUMMARY OF THE INVENTION

A fuel dispensing nozzle includes a body, a handle connected to the body, a handle guard connected to the body and generally surrounding the handle, and a spout extending from the body. Parts of the nozzle are made of, or covered in, static dissipative materials. Additionally, a method for reducing static discharge in existing nozzle installations include the application of static dissipative material to existing nozzles to address certain static discharge risks.

BRIEF DESCRIPTION OF THE DRAWINGS

Cross hatching in the Figures is intended to show a solid body in section. The pattern of the cross hatching has been selected to differentiate parts and is not intended to limit the material used in the various parts. By example, nozzle body 12 as shown in FIG. 2 may be made of metallic materials, such as steel or aluminum, or may be made of composite materials, as discussed in more detail below.

DETAILED DESCRIPTION OF THE EXEMPLARY EMBODIMENTS OF THE INVENTION

Definitions

Figure 1:
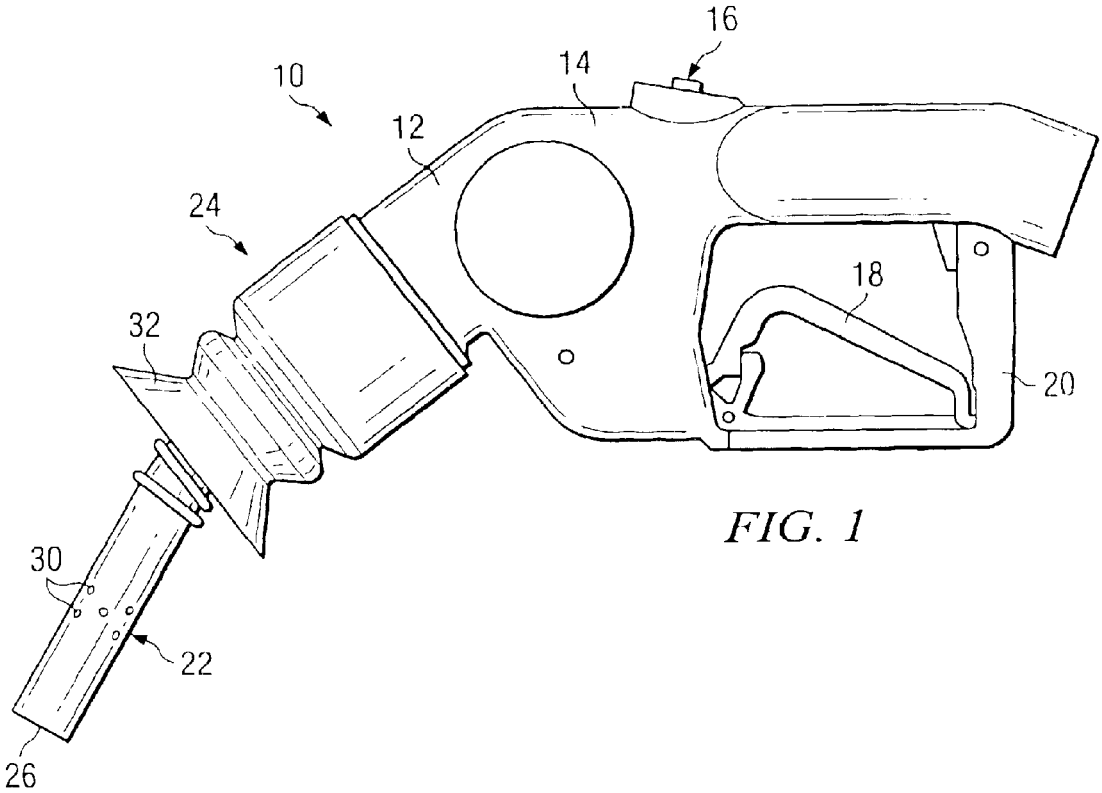
FIG. 1 is an exterior view of a fuel dispensing nozzle with vacuum assist vapor recovery capabilities.

As used herein, "static discharge" means the release of static electricity via an arc or spark between a charged object and another object. Static discharge can happen when a body comes into contact with another body at a sufficiently different potential. Electrostatic discharge can range from a voltage level just high enough to create a spark up to between 30,000–40,000 volts or higher. The actual voltage needed to create a spark depends on environmental factors, such as temperature and humidity, as well as material properties. Typically, static charge is the result of a transfer of electrons that occurs due to the sliding, rubbing or separating of a material which is a prime generator of electrostatic voltages, such as plastics, fiberglass, rubber, textiles, etc.

As used herein, the term "static dissipative material" means materials which have a surface resistivity of between approximately 0.5 megaohms/sq ($0.5\times10^6$ Ohm/sq) and approximately 1,000 megaohms/sq ($10^9$ Ohm/sq), plus or minus 0.2 megaohms/sq ($0.2\times10^6$ Ohm/sq), as measured using ASTM D257. While other materials may meet this definition, a commercially available material is sold under the tradename Stat-Kon® by LNP Engineering Plastics Inc. of Exton, Pa. Stat-Kon® is a thermoplastic composite which contains conductive additives. The conductive additives may be PAN Carbon Fibers, Pitch Carbon Fibers, Ni Plated Carbon Fibers, Stainless Steel Fibers, Carbon Powder, Metal Powders or Aluminum Flake, for example. Further discussion of such materials can be found at www.LNP.com and in particular in the brochure available therein entitled "Stat-Kon®)—A guide to LNP's line of thermoplastic composites for electrostatic dissipation", incorporated herein by reference.

In general terms, static dissipative materials reduce the likelihood of a static discharge by increasing resistance. A highly conductive material will allow an arc while the higher resistance of the static dissipative material will discourage transfer of electrical potential until physical contact is made. This allows the potential to dissipate without encouraging an arc or static discharge. This is to be distinguished from an insulative material which may prevent immediate arcing, but does not allow the potential to dissipate, thereby allowing future discharge when a conductive material is introduced.

As used herein, the term "structural materials" will mean materials that are not necessarily statically dissipative, but are required to meet structural requirements of a component. Structural materials would include aluminum, steel, composites, and other materials known to provide structural integrity to components manufactured thereof.

Nozzle

There are two major categories for fuel dispensing nozzles: vapor recovery (FIGS. 1–4) and non-vapor recovery (FIGS. 5–8). The non-vapor recovery models are designed to dispense fuel. The vapor-recovery models are designed to dispense fuel and recover fuel vapors from the fuel container or vehicle fuel tank for environmental reasons. Of the vapor recovery variety most are vacuum assist (FIGS. 1–4) or balance systems (not shown). Vacuum assist systems have a mechanism for drawing vapor from the area surrounding the nozzle, as is know in the art. Balance systems use a seal between the nozzle and the fuel container or vehicle fuel tank so that as liquid fuel is pumped into the container or tank fuel vapor is pushed into the vapor recover system. The balance system has construction that looks similar to a non-vapor recovery system, in that there are no vapor recovery holes in the nozzle spout, but includes enlarged bellows instead of a simple hood. The bellows must create a seal for the fuel to be dispensed.

The invention described herein may be used on a non-vapor recovery nozzle, a vacuum assist vapor recovery nozzle, or balance vapor recovery nozzle, as well as other fuel dispensing nozzles. Some other nozzles may include those used to transfer fuel off of fuel delivery trucks or those used to fuel off-road vehicles, such as lawn mowers, tractors, construction equipment, airplanes, race cars, motor cycles, model cars, and other vehicles which use flammable fuels. Furthermore, the spouts are shown in standard sizes, but may be larger or smaller as the application dictates. For example, gasoline spouts in the U.S. are typically smaller than diesel spouts in the U.S. due to regulatory requirements, while in Europe there is no such distinction.

Figure 4:
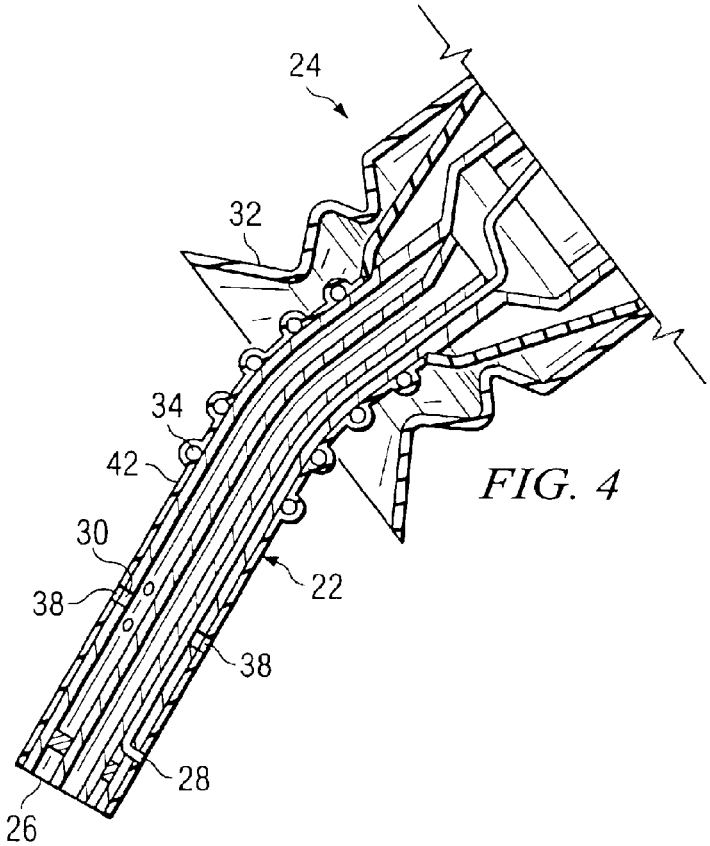
FIG. 4 is a cross-sectional view of the spout of a fuel dispensing nozzle with vapor recovery capabilities, as shown in FIGS. 1 and 2, with a coating of static dissipative material.
Figure 5:
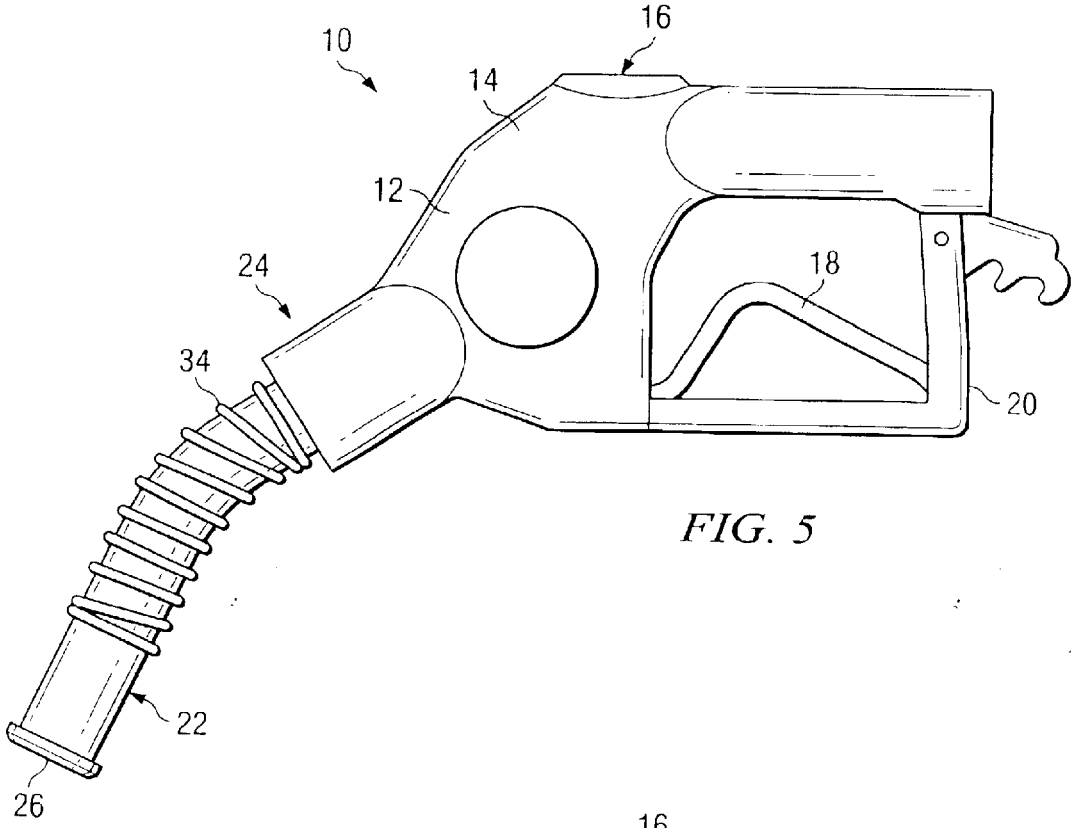
FIG. 5 is an exterior view of a fuel dispensing nozzle for applications without vapor recovery capabilities.

As shown in FIGS. 1, 2, 5, and 6, a nozzle 10 includes a body 12. Body 12 is typically adapted to be attached to a hose (not shown) which supplies fuel to the nozzle 10. Body 12 may also include a hand warmer 14 as shown in FIGS. 1 and 5. Body 12 includes a valve 16 which controls the flow of fuel through the nozzle 10. Attached to the body 12 is a handle 18 which controls the valve 16 such that a consumer can adjust the amount of flow through the nozzle 10. The handle 18 may include a lock-open feature allowing for unattended fueling. While this feature is popular, it allows customers to return to their vehicles or enter the convenience store and develop a static charge. Nozzles 10 typically include a handle guard 20 as shown in FIGS. 1, 2, 5, and 6 to prevent accidental discharge of fuel. The handle guard 20 also allows the customer to lock the nozzle 10 open while fuel is being dispensed into the vehicle fuel tank and allows the customer to either return to the vehicle or go into the convenience store. A spout 22 is typically attached to the body 12 to engage a container into which the nozzle 10 transfers fuel. The spout 22 may come in several variations as shown in FIGS. 1 through 8. Generally, the spout 22 will include a nozzle end 24 which is connected to body 12 and a dispensing end 26 opposite the nozzle end 24. Additionally, the spout 22 will often include an automatic overflow shut off hole 28 near the dispensing end 26. Automatic shut off hole 28 is fluidly connected to a venturi valve which shuts off valve 16 when the fuel level in a container reaches the shut off hole 28 of the spout 22. Additionally, many spouts, such as that shown in FIGS. 1, 2, 3, and 4, will include vapor recovery holes 30. The vapor recovery holes 30 are well known in the art to provide a passage for the recovery of fuel vapors back into the fuel storage tank. A hood 32 as shown in FIGS. 1–4 will assist in capturing vapors and reduce the chance of a consumer being splashed with fuel if they overfill the vehicle or container. Coils 34, as shown prominently in FIGS. 5, 6, 7 and 8, and often included in vapor assist nozzles, as shown in FIGS. 1–4, may be used to help in maintaining the spout 22 in a fuel container or fill tube of a vehicle.

In use the nozzle 10 is grasped about the body 12 by a consumer who places the spout 22 into a container or fill tube of a vehicle. The consumer then grasps the handle 18 thereby activating valve 16 to dispense fuel through the spout 22 into the container or fill tube of a vehicle. In typical operation, the spout 22 will come into contact with the container or fill tube of a vehicle as will the hood 32. The consumer will come into contact with at least the body 12, or the hand warmer 14, and the handle 18. It is also possible for the customer to grasp the nozzle 10 by handle guard 20.

In order to effectively reduce static discharge, various parts and surfaces of nozzle 10 must be comprised of static dissipative material. In a most preferred embodiment, all outer surfaces of nozzle 10 will be comprised of, made from, coated with, or covered with, static dissipative material, but various combinations of surfaces can also be effective to address various issues. Additionally, total coverage of the surfaces with static dissipative material may not be necessary. For example, insulative surfaces may be combined with static dissipative surfaces and surfaces which receive exceptional wear may be coated with wear strips of structural material, whether the structural material is insulative, conductive, or dissipative.

Sleeves and Coatings

The use of composites in this invention can be advantageous when a coating or sleeve if preferred. Such thermoplastic composites which are static dissipative may include a polymer with additives to adjust the surface resistivity of the composite. Such composites may have base resins of ABS, Polystyrene, Polycarbonate, Polyetherimide, Polyethylene, Polysulfone, Nylon 11, Nylon 6/12, Polyethersulfone (PES) Acetal, Polyetheretherketone (PEEK), Polypropylene, Polyphenylene Sulfide, Nylon 6, Nylon 6/10, Nylon 6/6, Nylon 12, Polyurethane, Polyphthalamide (PPA), Super Tough Nylon, Thermoplastic Polyester (pbt), Amorphous Nylon, Polyester Elastomer, and Modified Polyphenylene Oxide, for example. Such composites may have various additives to reduce the surface resistivity of the base resin, such as PAN Carbon Fibers, Pitch Carbon Fibers, Ni Plated Carbon Fibers, Stainless Steel Fibers, Carbon Powder, Metal Powders, Aluminum Flakes, Migratory Antistat, and Permanent Antistat, for example.

Figure 2:
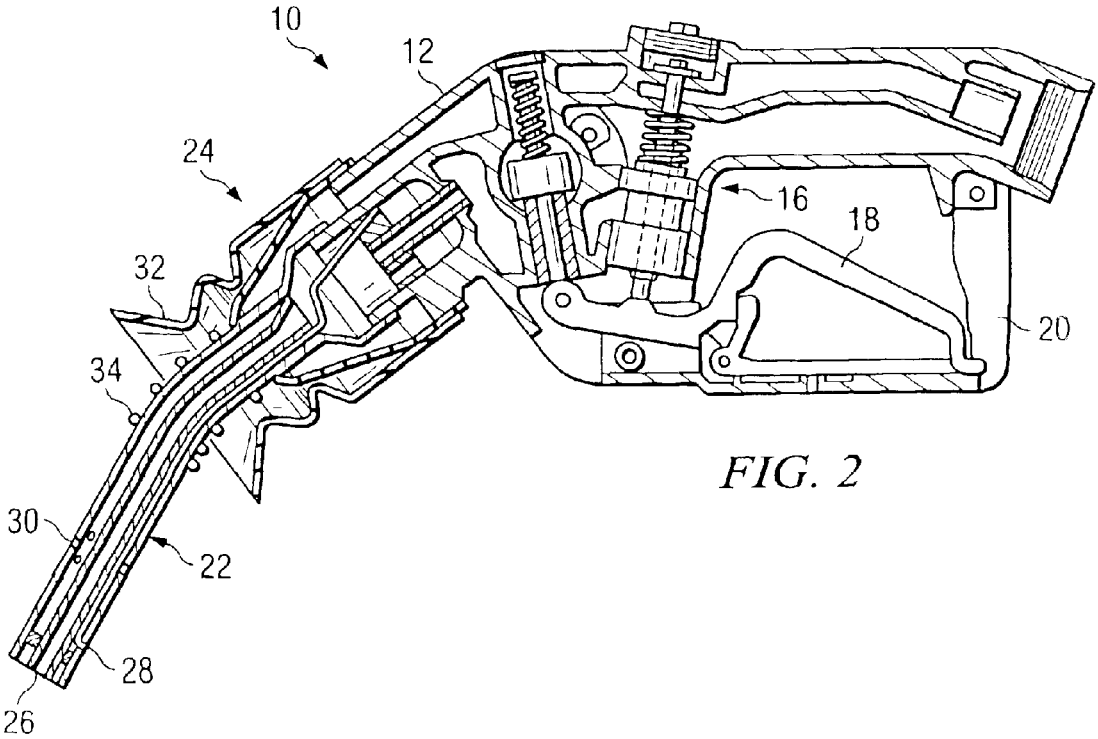
FIG. 2 is a cross-sectional view of the fuel dispensing nozzle with vapor recovery capabilities of FIG. 1.
Figure 6:
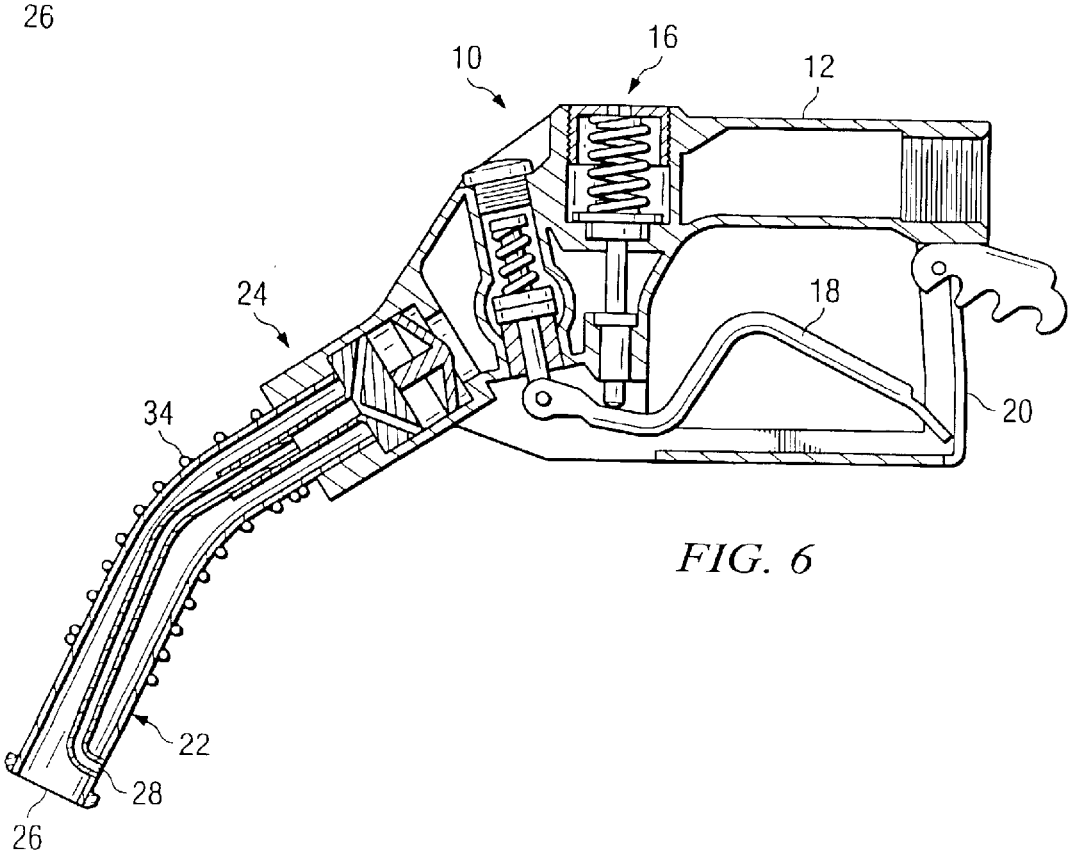
FIG. 6 is a cross-sectional view of a fuel dispensing nozzle for of FIG. 5.

One of the advantages of thermoplastic composites is that they may be formed into sleeves 36 that conform to the shape of a structural member such as the body 12, handle 18, handle guard 20, or spout 22, as shown in FIGS. 2 and 6. The sleeves 36 may include holes 38 to align with holes in the structural member, for example, the automatic shutoff hole 28 and vapor recovery holes 30. Additionally, the sleeve 36 may have ribs 40, which are similar in shape and size to coils 34, to maintain the spout 22 in a container. Furthermore, the sleeve 36 may be made of material that contracts when exposed to certain high temperatures so that the sleeve 36 may be secured by "heat-shrinking" the sleeve 36 onto a structural member. Alternatively, the sleeve 36 may be secured simply through an interference fit, adhesive bonding, or other acceptable means such as using a slightly elastic polymer to stretch the sleeve 36 over the structural member while maintaining static dissipative properties.

Another possible implementation when using thermoplastic composites is to coat a structural member, such as the body 12, handle 18, handle guard 20, or spout 22, with a coating 42. One method for coating would be to coat the structural member with a molten thermoplastic composite having the desired surface resistivity. Another method would be to combine a composite with a vehicle and coat the structural member with the composite and vehicle so that when the vehicle substantially evaporates the structural member is left with coating 40 of the composite while maintaining static dissipative properties.

Structural Static Dissipative Materials

Another advantage of composite materials is the ability to combine structural properties with static dissipative properties. By choosing more structural base composites, such as nylons or polycarbonates, along with additives that impart both strength and static dissipative properties, such as carbon fibers or steel fibers, or a mixture of strength additives and static dissipative additives, such as glass fiber with aluminum flake, a structural composite with appropriate static dissipative properties can be formed. The specific formulation will be dependent on several factors, including: the fuel the part is exposed to, if any; the stresses encountered by the part; the expected life of the part; and the amount of flexure allowed in the part. The advantages of the various ingredients is discussed in more detail in the Stat-Kon® brochure referred to above, and incorporated by reference.

Accordingly, any of the main structural features of the nozzle, as shown in FIGS. 1, 2, 5, and 6, may be manufactured of structural static dissipative material, including: the body 12; the hand warmer 14; the handle 18; the handle guard 20; the spout 22; the hood 32; and the coils 34. In a preferred embodiment of the invention the spout 22 is made of a structural dissipative material. In another preferred embodiment, the spout 22 and the handle 18 are each made of structural static dissipative materials. In another preferred embodiment, the spout 22, the handle 18, and the handle guard 20, are each made of structural static dissipative material. In yet another preferred embodiment, the body 12 is made of a structural static dissipative material. In yet another preferred embodiment, the body 12 and the spout 22 are each made of structural static dissipative materials. In yet another preferred embodiment the body 12, the spout 22, and the handle 18 are made of structural static dissipative materials. In yet another preferred embodiment, the body 12, the spout 22, the handle 18, and the handle guard 20 are comprised of a structural static dissipative material.

Spout

Figure 3:
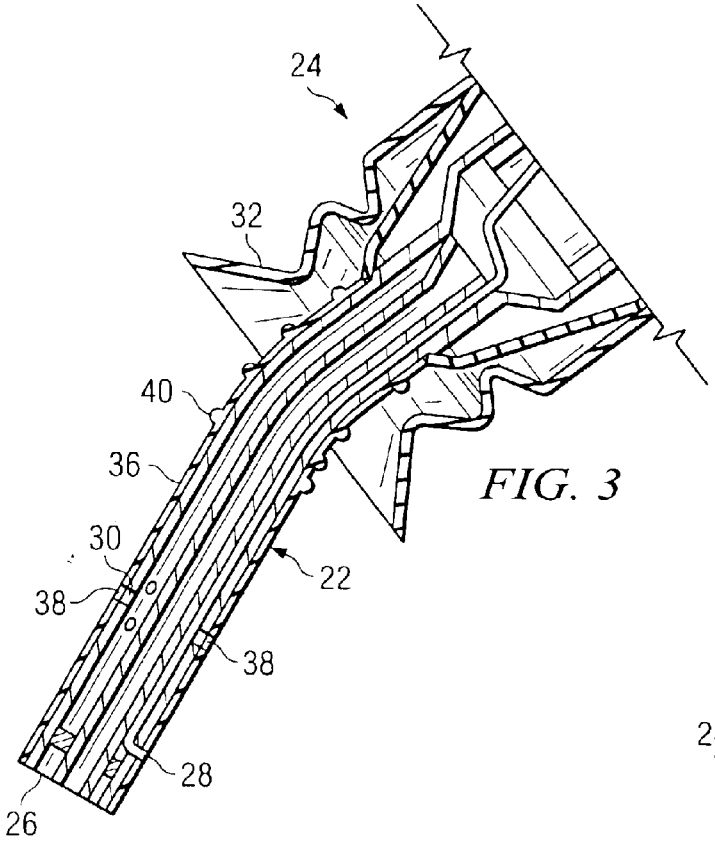
FIG. 3 is a cross-sectional view of the spout of a fuel dispensing nozzle with vapor recovery capabilities, as shown in FIGS. 1 and 2, with a sleeve of static dissipative material.
Figure 7:
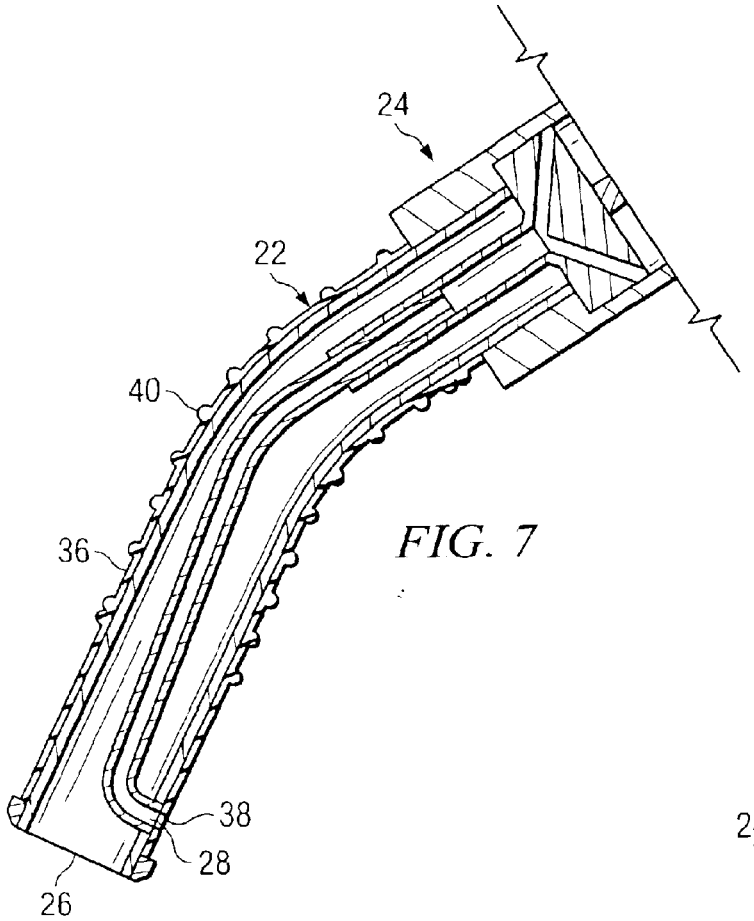
FIG. 7 is a cross-sectional view of the spout of a fuel dispensing nozzle for high-flow applications, as shown in FIGS. 5 and 6, with a sleeve of static dissipative material.
Figure 8:
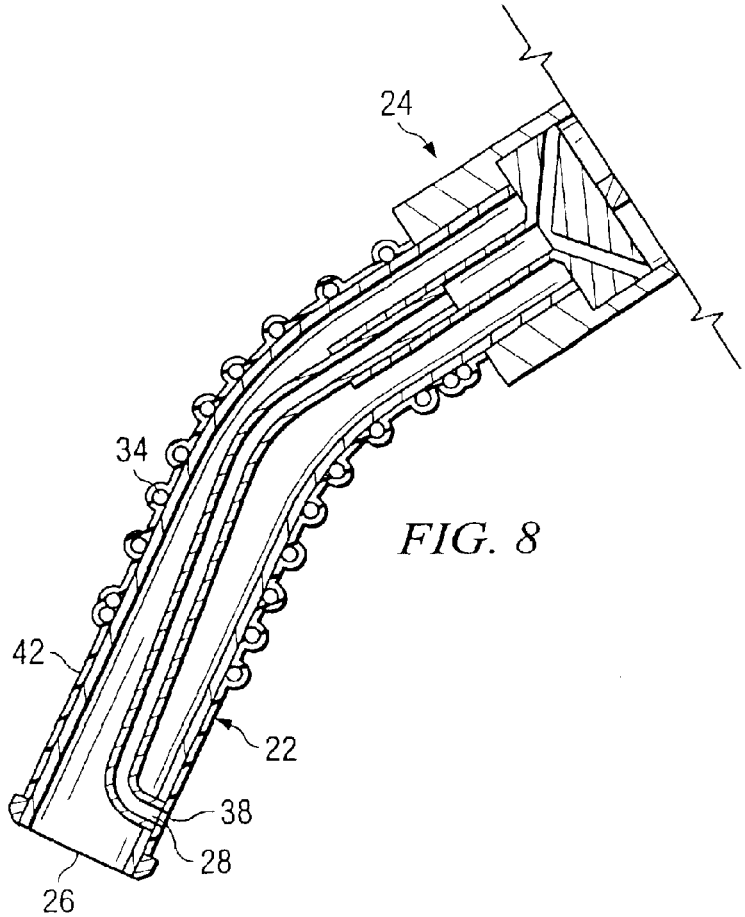
FIG. 8 is a cross-sectional view of the spout of a fuel dispensing nozzle for high-flow applications, as shown in FIGS. 5 and 6, with a coating of static dissipative material 22.

Various spout designs are shown in FIGS. 1 through 8. The spout 22 of FIGS. 3 and 4 is that of a vapor assist nozzle 10 while the spout 22 of FIGS. 7 and 8 is that of a high flow nozzle 10. Both spouts 22 include a nozzle end 24 and dispensing end 26, as well as an automatic overfill shut off hole 28. Additionally, the spout 22 of FIGS. 3 and 4 includes vapor recovery holes 30. In order to provide static dissipative performance in cases where spout-to-can sparks may otherwise occur, the spout 22 must be comprised, at least partially, of static dissipative material. Either the spout 22 of FIGS. 1 and 2, or the spout 22 of FIGS. 5 and 6, may be comprised completely of static dissipative materials. Alternatively, the spout 22 may be comprised of structural material covered in either a sleeve of static dissipative material as shown in FIGS. 3 and 7, or a coating of static dissipative material as shown in FIGS. 4 and 8. The advantage of a sleeve or coating is that existing spouts may be used without having to replace spouts 22. Additionally, the sleeve or coating may allow for stronger spouts 22 where necessary.

Body

Body 12 is typically covered by hand warmer 14, which is typically insulative in the prior art, but may be static dissipative in accordance with the present invention. But, hand warmer 14 may be damaged thus exposing body 12 to static discharge. Therefore, body 12 may be created entirely of a static dissipative material, or it may be coated or sleeved in a static dissipative material, similar to spout 22 discussed above. The advantage of coating or sleeving body 12 is that existing bodies 12 may be coated or sleeved for continued use. Furthermore, a coated or sleeved body 12 will give various options as to the structural material to be used below the coating or sleeve. Hand warmer 14 may be comprised of a static dissipative material.

Handle and Handle Guard

Handle 18 may be comprised entirely of a static dissipative material. This should not provide structural difficulties because many handle 18 currently on the market are made of insulative composites with similar structural properties to the static dissipative composites disclosed herein. If particular structural properties are desired, a handle 18 of structural material may be coated or sleeved in a static dissipative material. Additionally, handle guard 20 may be made entirely of static dissipative material. This should not provide structural difficulties because many handle guards 20 currently on the market are made of insulative composites with similar structural properties to the static dissipative composites disclosed herein. If particular structural properties are desired, a handle guard 20 of structural material may be coated or sleeved in static dissipative similar to spout 22 discussed above or electrically insulated from the body 12 and handle 18.

Retrofitting and Replacement

In addition to the novel nozzle designs mentioned above, a method for reducing static discharge in existing nozzles installations would comprise retrofitting existing nozzles with certain portions of the above designs instead of replacing the entire nozzle. In a preferred embodiment, existing hand warmer 14 of existing nozzle 10 is replaced with a static dissipative hand warmer 14. In another preferred embodiment, existing handle guard 20 of existing nozzle 10 is replaced with a static dissipative handle guard 20. Likewise, existing spout 22, existing handle 18, and existing hood 32, may each be replaced by static dissipative spout 22, handle 18, and hood 32, respectively. The replacement parts may be made of, coated with, or covered by, static dissipative materials.

Another method for reducing static discharge in existing nozzle installations would include the application of static dissipative coatings to existing nozzle parts. In a preferred embodiment a static dissipative material is combined with a vehicle such that when the combination is viscous and may be applied to an existing part. The vehicle is then removed; for example the vehicle may evaporate at room temperature or elevated temperatures leaving the static dissipative coating. In a preferred embodiment the combination is applied to the exterior surfaces of nozzle 10. In another preferred embodiment, the combination is applied to the exterior surfaces of the spout 22, as shown in FIGS. 4 and 8. In another preferred embodiment, the combination is applied to the spout 22 and the handle 18. Various other exterior surfaces may be selected for particular applications.

Yet another method for reducing static discharge in existing nozzle installations would include the fitting of sleeves of static dissipative material over existing components. This could include elastomeric sleeves, friction fit sleeves, and heat shrinkable sleeves, among other designs. In a preferred embodiment a sleeve is fitted over an existing spout 22, as shown in FIGS. 3 and 7. In another preferred embodiment a sleeve is fitted over either the body 12, the handle 18, the spout 22, or the handle guard 20, or a combination of these parts. An advantage of the sleeve is that it may include exterior surface features to increase the performance of the part, such as ribs 40 on the spout 22, or a knurled gripping surface on the handle 18 or the body 12.

CONCLUSION

As various changes could be made in the above construction without departing from the scope of the invention, it is intended that all matter contained in the above description or shown in the accompanying drawings be interpreted as illustrative and not in a limiting sense. Having thus described the invention, what is claimed and desired to be secured by the patent is to be found in the appended claims.

I claim:

1. A fuel dispensing nozzle comprising:

a body;

a handle connected to the body;

a handle guard connected to the body and generally surrounding the handle;

a spout extending from the body; and at least one of the body, handle, handle guard, and spout is made of a structural material covered with a static dissipative material.

2. The fuel dispensing nozzle of claim 1 wherein said structural material is covered with a coating of static dissipative material.

3. The fuel dispensing nozzle of claim 1 wherein said structural material is covered with a sleeve of static dissipative material.

4. The fuel dispensing nozzle of claim 1 wherein the spout is made of a structural material covered with a coating of static dissipative material.

5. The fuel dispensing nozzle of claim 1 wherein the spout is made of a structural material covered with a sleeve of static dissipative material.

6. The fuel dispensing nozzle of claim 1 wherein the body is comprised of a structural material covered with a coating of static dissipative material.

7. The fuel dispensing nozzle of claim 1 wherein the body is comprised of a structural material covered with a sleeve of static dissipative material.

8. The fuel dispensing nozzle of claim 1 wherein the handle is comprised of a structural material covered with a coating of static dissipative material.

9. The fuel dispensing nozzle of claim 1 wherein the handle is comprised of a structural material covered with a sleeve of static dissipative material.

10. The fuel dispensing nozzle of claim 1 wherein the handle guard is comprised of a structural material covered with a coating of static dissipative material.

11. The fuel dispensing nozzle of claim 1 wherein the handle guard is comprised of a structural material covered with a sleeve of spark dissipative material.

12. The fuel dispensing nozzle of claim 1 wherein the handle guard is electrically insulated from the body and handle.

13. A fuel dispensing nozzle comprising:

a body;

a handle connected to the body;

a handle guard connected to the body and generally surrounding the handle;

a spout connected to the body; and at least one of the body, handle, handle guard, and spout is made of a static dissipative material.

14. The fuel dispensing nozzle of claim 13 wherein the handle is made of a static dissipative material.

15. The fuel dispensing nozzle of claim 13 wherein the body is made of a static dissipative material.

16. The fuel dispensing nozzle of claim 13 wherein the handle guard is made of a static dissipative material.

17. The fuel dispensing nozzle of claim 13 wherein the handle guard is electrically insulated from the body and handle.

18. The fuel dispensing nozzle of claim 13 wherein the spout is made of a static dissipative material.

19. The fuel dispensing nozzle of claim 13 wherein the spout is made of a structural material and an exterior coating of static dissipative material.

20. The fuel dispensing nozzle of claim 13 wherein the spout is made of a structural material and a sleeve of static dissipative material.

21. A method for reducing static discharge at existing nozzle installations, the method comprising the steps of:

locating an existing nozzle with a body, handle, handle guard and spout;

identifying a static discharge risk to be addressed; and applying static dissipative materials to at least a portion of the existing nozzle to reduce the identified static discharge risk.

22. The method of claim 21 wherein:

the identified risk to be reduced is static discharge associated with the spout; and the applying includes covering the spout in static dissipative material.

23. The method of claim 22 wherein:

the covering includes fitting a sleeve to the existing spout.

24. The method of claim 22 wherein:

the covering includes coating the existing spout in static dissipative material.

25. The method of claim 21 wherein:

the identified risk to be reduced is static discharge associated with the spout; and the applying includes replacing the existing spout with a replacement spout made of static dissipative materials.

26. The method of claim 21 wherein:

the identified risk to be reduced is static discharge associated with the body; and the applying includes covering the body in static dissipative material.

27. The method of claim 26 wherein:

the covering includes addition of a hand warmer comprised of static dissipative material.

28. The method of claim 26 wherein:

the covering includes coating the body in static dissipative material.

29. The method of claim 26 wherein:

the covering includes fitting a sleeve of static dissipative material over the body.

30. The method of claim 21 wherein:

the identified risk to be reduced is static discharge associated with the handle; and the applying includes replacing the existing handle with a replacement handle made of static dissipative materials.

31. The method of claim 21 wherein:

the identified risk to be reduced is static discharge associated with the handle; and the applying includes covering the handle with a static dissipative material.

32. The method of claim 31 wherein:

the covering includes fitting a sleeve of static dissipative material over the existing handle.

33. The method of claim 31 wherein:

the covering includes coating the existing handle with static dissipative material.

* * * * *